US005451058A

United States Patent [19]

Price et al.

[11] Patent Number: 5,451,058

[45] Date of Patent: Sep. 19, 1995

[54] LOW CENTER OF GRAVITY GOLF CLUB

[76] Inventors: Parker G. Price, 11 Lochmore Ter., Charleston, S.C. 29414; Andrew C. Becher, 9 Ironwood La., North Oaks, Minn. 55127; Harold E. Mesirow, 4970 Sentinel Dr. Apt. 206, Bethesda, Md. 20816

[21] Appl. No.: 238,374

[22] Filed: May 5, 1994

[51] Int. Cl.[6] ..... A63B 53/04

[52] U.S. Cl. ..... 273/173; 273/167H

[58] Field of Search ..... 273/167 R, 167 D, 167 E, 273/167 F, 167 G, 167 H, 167 J, 169, 170, 171, 172, 173, 174, 193 R, 194 R, 194 B, 187.4, 77 R

[56] References Cited

U.S. PATENT DOCUMENTS

| | | | |
|---|---|---|---|
| 2,087,685 | 7/1937 | Hackney . | |
| 2,954,231 | 9/1960 | MacIntyre . | |
| 3,190,651 | 6/1965 | Thomas | 273/173 |
| 3,212,783 | 10/1965 | Bradley et al. . | |
| 3,567,228 | 3/1971 | Lynn . | |
| 3,637,218 | 1/1972 | Carlino | 273/167 H |
| 3,841,640 | 10/1974 | Gaulocher . | |
| 4,065,133 | 12/1977 | Gordos | 273/167 E |
| 4,076,254 | 2/1978 | Nygren . | |
| 4,213,613 | 7/1980 | Nygren . | |
| 4,465,221 | 8/1984 | Schmidt | 273/173 |
| 4,681,321 | 7/1987 | Chen | 273/167 H |
| 4,811,949 | 3/1989 | Kobayashi | 273/167 H |
| 4,815,739 | 3/1989 | Donica . | |
| 5,000,454 | 3/1991 | Soda | 273/173 |
| 5,080,366 | 1/1992 | Okumoto et al. . | |

FOREIGN PATENT DOCUMENTS 526236 2/1975 Japan .

*Primary Examiner*—Sebastiano Passaniti
*Attorney, Agent, or Firm*—Hugh D. Jaeger

[57] ABSTRACT

A golf club having a force transfer assembly molded or formed internally in the golf club head whereby plate and ring members reinforce the striking surface to more efficiently impact the force of the golfer's swing to the golf ball.

20 Claims, 4 Drawing Sheets

LOW CENTER OF GRAVITY GOLF CLUB

BACKGROUND OF THE INVENTION

1. Field of the Invention

The present invention pertains to sports equipment, and more particularly, relates to a golf club such as a driver or other golf club having a low center of gravity at the head.

2. Description of the Prior Art

The standard driver golf club head or other golf clubs include a hollow thin metal wall head which transfers the potential energy of a golfer's swing to the golf ball when the ball comes in contact with the club face.

When a golfer swings, a finite or fixed amount of potential energy is available in the club head to propel the ball. The perfect club head would transmit 100% of this potential into kinetic energy imparted to the ball. A traditional club head, not being a perfect club, wastes considerable energy. Standard golf clubs are reinforced with foam, and their weight is not in contact with the trailing edge of the club face or with the sole plate. Since there is no direct in line connection of the sole plate to the impact point, energy is not effectively channeled to the ball.

With prior art heads, energy is transmitted into the face metal which is supported at the top, the bottom and the sides but lacks support at the areas in between. The face bends non-uniformly depending on the point of impact with the face resulting in hot spots in the metal face and resulting in inconsistent transmission of energy to the ball.

When a golfer swings, energy is available through the club to propel the ball. The traditional metal club head (as well as wood) is inefficient in that "perimeter-weighting" is not connected to the face like in irons. With other club heads, the golf clubs have large face areas, but lack support on the face "in-between," certainly not to the rear of the club and the sole. The result is "hot-spots" in the face metal, resulting in inconsistent bending, and thereby inconsistent transmission of energy of the ball. Contact at the center or near the perimeter rings in the new design result in contact between the face and sole plate areas and consistent transmission of energy.

SUMMARY OF THE INVENTION

The general purpose of this invention is to increase the efficiency of the golf club head, or in other words, transfer more of the available potential energy to the ball. This new invention accomplishes this improved efficiency through the addition of a light weight steel integrated support wall and ring assembly. The rings and walls strengthen the impact surface of the club head and act as an energy transmitting medium to the club head's lowest center of gravity point. Past attempts at producing an oversize golf club head started with the basic hollow thin metal head concept. However, to date, club production have limited improvements in club heads to a thicker impact wall or distributed weights to different points of the club head. The present invention goes well beyond this concept by increasing club head strength and efficiency by delivering energy to the lowest center of gravity point.

According to embodiments of the present invention, the golf club face, which is traditionally a thin metal wall, is reinforced by an additional steel frontal wall. The frontal wall is perpendicular to and welded to a vertical wall. The bottom of both walls lie on, and are welded to a sole plate. Two metal impact rings, half-circles made of steel, are welded to the frontal wall. The diameter of the inner ring for purposes of illustration can be one inch. The diameter of the outer ring can be two inches. The two rings are centered about the vertical wall. Both ends of each ring are welded to the rear of the frontal wall. The rings then curve back into the club head and are angled downward preferably 45 degrees or any other desired angle. The rings then pass through and secure to the vertical wall and continue back to the frontal wall where they are welded in place. The purpose of the reinforced club is to reinforce the club head face hitting surface so that when the golf ball impacts the club, an efficient launch force is imparted via the reinforced steel parts. The impact rings act as an energy transmitting medium which, in effect, brings the sole plate, vertical wall and frontal wall in direct contact with the golf ball. The rings which can be angled down effectively lowers the center of gravity of the golf club, ultimately leading to improved lift and a longer golf shot. This new design or reinforced concept enhances energy transmission for the good golf shot and the bad golf shot alike. The best shots occur when the ball impacts the very center of the club face. Since the vertical wall is directly behind the center, it acts as a medium and energy is transmitted from the sole plate, to the vertical wall, to the frontal wall and finally to the golf ball itself. For a shot off center the impact rings act as the energy medium. The force of the sole plate is transmitted to the vertical wall, then to the impact rings, then to the frontal wall and finally to the golf ball.

If weight wasn't a factor, the ultimate club head would be solid steel. But weight obviously is a factor. The reinforced club head concept makes the head and face more structurally solid and efficient while keeping the overall weight the same. It enhances the golf shot regardless of impact point.

One significant aspect and feature of the present invention is a golf club having a reinforcing frontal wall behind the club head face and attached to the club sole plate. A vertical wall supports and aligns perpendicular to a frontal wall, and secures to a sole plate of a golf club.

Another significant aspect and feature of the present invention is arcular impact or pressure transmittal rings secured to the frontal wall and to the vertical wall. The combination of a frontal wall member, a vertical wall member and arcular rings secured to each other as a unit or assembly. Arcular impact rings angle downwardly from the vertical wall to deliver force to a low point of the golf head. This provides uniform transmission of energy so that there is a resistance to deflection on all other shots.

Yet another significant aspect and feature of the present invention is golf clubs which are more forgiving to off center hits and increasing the power when hit. The mass is concentrated at the hitting area and below it to cause more effective striking and lifting of the ball within the normal weight requirements.

Other significant aspects and features of the present invention is that significantly more energy is transmitted directly to the ball with the same amount of swing energy and not just a redistribution of total weight where strengthening is: (1) directly in contact with the ball, (2) where significantly increased efficiency of transmission of energy by direct contact to the rear of the head and also the sole plate occurs, and (3) results in energy being transmitted downward and up to the ball resulting in getting the ball airborne more easily.

Having thus described embodiments of the present invention, it is the principal object of the present invention to provide a golf club having a low center of gravity including a metal golf club, all metal golf clubs ranging from a number 1 through 9, and other suitable clubs.

One object of the present invention is that if the point of ball contact is in the center or anywhere near the rings perimeter reinforcement which is in contact with the face and downward areas results in energy being transmitted to the plate and downwardly with the result that the transmission is more efficient and it is under the ball which means the ball will become airborne more easily. Transmission of energy occurs more effectively if one can connect the reinforcement to the area that is being struck, not just by shifting weight in the club head. The low center of gravity club has perimeter-weighting by the connection lines to the rear of the club fact and sole plate reinforcements.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENTS

Figure 1:
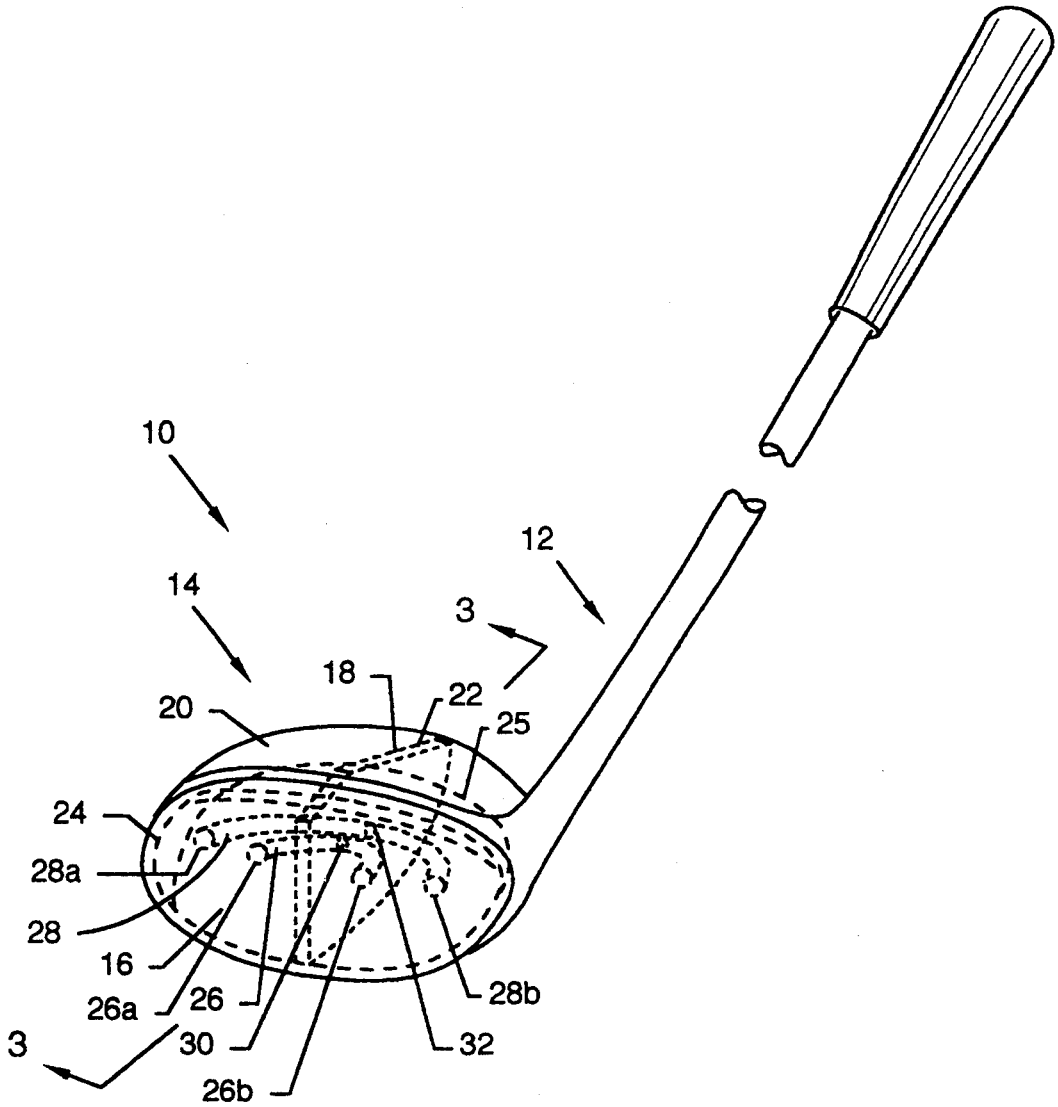
FIG. 1 illustrates a perspective view of a low center of gravity golf club.

FIG. 1 illustrates a perspective view of a low center of gravity golf club 10, the present invention, including a handle 12 and a head 14. The head is a predetermined geometrical shape. The handle 12 is integral to and blends into a face plate 16. Part of a force transfer plate 18 aligns to the rear of the face plate 16 and is secured thereto by an overmolded molded member 20 of plastic, metal or other desired composite. The force transfer assembly 18 includes a vertical plate member 22 aligned at a right angle and secured to a frontal planar plate member 24 and a sole plate 25 secured along the bottom edge of the frontal planar plate member 24 and along the bottom edge of the vertical plate member 22. The force transfer assembly 18 also includes an inner transmittal or impact ring 26 and an outer transmittal or impact ring 28 secured to the rear surface of the frontal plate member 24 at their arcular ends 26*a*, 26*b*, 28*a* and 28*b*. The impact rings 26 and 28 also pass at an angle downwardly through and are welded to orifices 30 and 32 in the vertical plate member 22. The impact ring or rings can be parallel or at an angle, and in any 3-dimensional spaced relationship with respect to each other. The drawings are representative of just one example and is not to be construed as limiting of the present invention.

Figure 2:
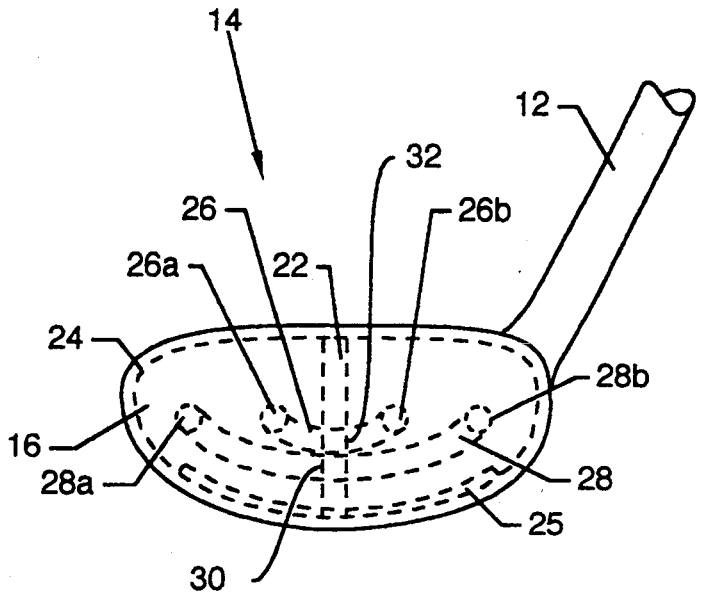
FIG. 2 illustrates a frontal view of the golf club head.

FIG. 2 illustrates a frontal view of the golf club head 14 where all numerals correspond to those elements previously described. Illustrated in particular is the orientation of the impact rings 26 and 28 with respect to the horizontal plane. The semi-circular impact rings 26 and 28 are canted downwardly at approximately 45° or other desired angle toward the back of the golf club head 14 to pass through orifices 32 and 30 in the vertical plate member 22 which align at a point lower than that of the arcular ends of 26*a*–26*b* and 28*a* and 28*b* of the transmittal rings 26 and 28.

Figure 3:
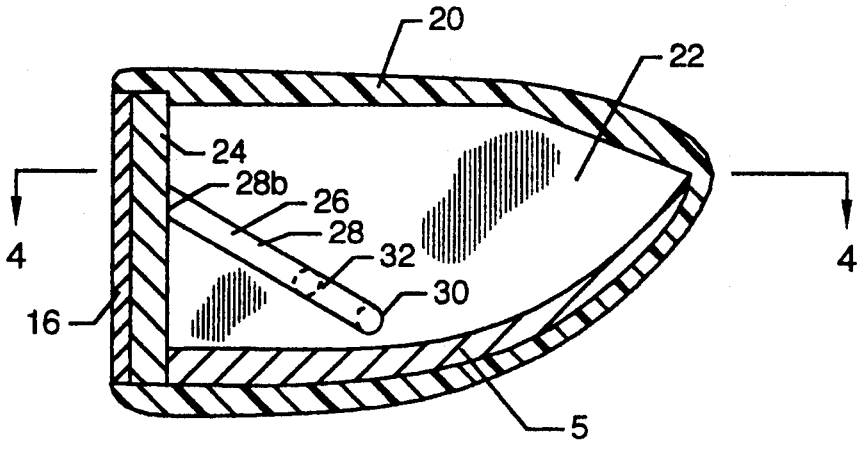
FIG. 3 illustrates a cross sectional side view of the golf club head along line 3—3 of FIG. 1; and, FIG. 4 illustrates a cross sectional top view along line 4—4 of FIG. 3.

FIG. 3 illustrates a cross sectional side view along line 3—3 of FIG. 1 where all numerals correspond to those elements previously described. Illustrated in particular are the impact rings 26 and 28 which can angle downwardly to intersect holes 30 and 32 in the vertical plate member 22.

Figure 4:
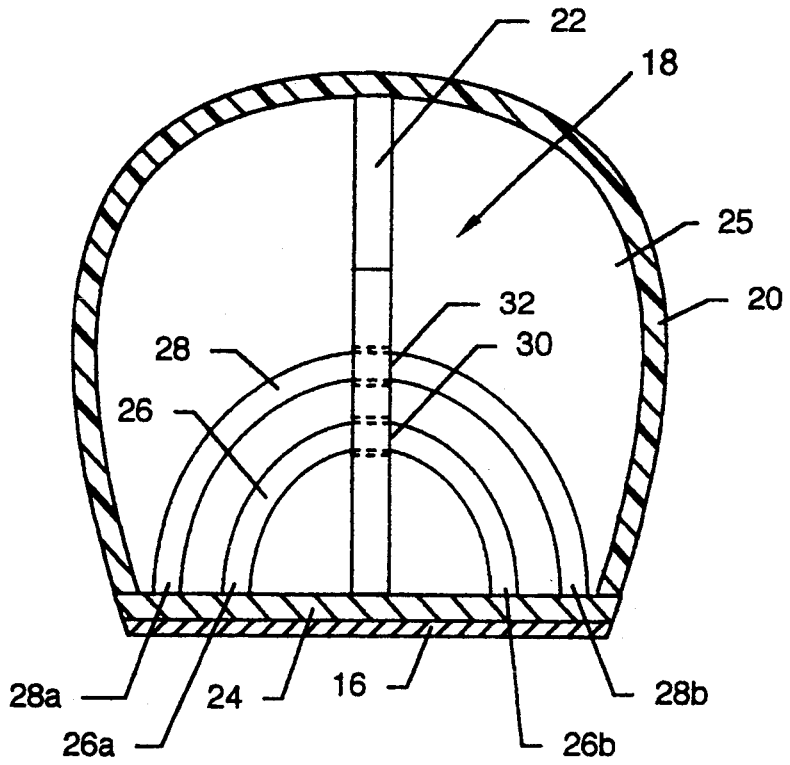

FIG. 4 illustrates a cross sectional top view along line 4—4 of FIG. 3 where all numerals correspond to those elements previously described.

MODE OF OPERATION

When a golfer swings, energy is available through the club to propel the ball. The traditional metal clubhead (as well as wood) is inefficient in that "perimeter-weighting" is not connected to the face like in irons. The club of the present invention has perimeter-weighting by the connection lines to the rear of the clubface and soleplate reinforcements. With other prior art club heads, they have large face areas but lack support on the face "in-between," certainly not to the rear of the club and the sole. The result is "hot-spots" in the face metal, resulting in inconsistent bending, and thereby inconsistent transmission of energy of the ball. Contact at the center or near the perimeter rings in the present invention results in contact between the face and soleplate areas and consistent transmission of energy. The reinforced face and the soleplate/rear enforcement provide more efficient and more uniform power transmission. Also, the golf clubs is more forgiving to offsetter's hits Significantly more energy is transmitted directly to the ball with the same amount of swing energy. The golf club is (1) directly in contact with the ball, and we also have (2) significantly increased the efficiency of transmission of energy by direct contact to the rear of the head and also the soleplate, (3) resulting in energy being transmitted downward and up into the ball, resulting in getting it airborne more easily.

Various modifications can be made to the present invention without departing from the apparent scope hereof.

I claim:

1. A golf club comprising:

a. a golf club including a generally hollow member forming a predetermined geometrical shape;

b. a force transfer plate extending from top to bottom of said shape;

c. at least one ring having two free ends extending through said force transfer plate, the ring lying inside the hollow member, spaced apart from the hollow member; and, d. a face secured over said member, said plate and to each end of said ring.

2. A club of claim 1 including more than one ring.

3. A club of claim 2 wherein said rings are parallel to each other.

4. A club of claim 2 wherein said rings are at an angle with respect to each other.

5. A club of claim 1 wherein said club is a driver.

6. The club of claim 1 wherein said club is an iron.

7. The club of claim 1 wherein said club is a putter.

8. A golf club comprising:

a. a golf club including a generally hollow member forming a shape;

b. a force transfer plate extending from top to bottom of said shape;

c. at least two rings each having two ends extending through said force transfer plate and inside the hollow member, spaced apart from said hollow member; and, d. a face secured over said member, said plate and to each end of said ring.

9. The club of claim 8 wherein said rings are parallel to each other.

10. The club of claim 8 wherein said rings are at an angle with respect to each other.

11. The club of claim 8 wherein said club is a driver.

12. The club of claim 8 wherein said club is an iron.

13. The club of claim 8 wherein said club is a putter.

14. A gold club comprising:

a. a golf club including a hollow member forming a shape;

b. a force transfer plate extending from top to bottom of said shape;

c. at least one partial ring having two ends extending through said force transfer plate inside and spaced apart from said hollow member; and, d. a face secured over said member, said plate and to each end of said ring.

15. The club of claim 14 including a second ring wherein said rings are parallel to each other.

16. The club of claim 14 including a second ring wherein said rings, are at an angle with respect to each other.

17. The club of claim 14 wherein said club is a driver.

18. The club of claim 14 wherein said club is an iron.

19. The club of claim 14 wherein said club is a putter.

20. The club of claim 14 wherein said club is of a metal alloy or aluminum.

* * * * *